US005413171A

United States Patent [19]

Womack

[11] Patent Number: 5,413,171

[45] Date of Patent: May 9, 1995

[54] LATCHING AND SEALING ASSEMBLY

[75] Inventor: Robert E. Womack, Humble, Tex.

[73] Assignee: Downhole Systems, Inc., Houston, Tex.

[21] Appl. No.: 164,158

[22] Filed: Dec. 9, 1993

Related U.S. Application Data

[63] Continuation-in-part of Ser. No. 877,312, May 1, 1992, abandoned.

[51] Int. Cl.[6] ..... E21B 31/18

[52] U.S. Cl. ..... 166/98; 285/315; 285/323; 294/86.31

[58] Field of Search ..... 166/98, 99, 77.5, 85; 294/86.3, 86.31, 86.33, 86.34; 285/315, 321, 323, 348, 374

[56] References Cited

U.S. PATENT DOCUMENTS

| | | | |
|---|---|---|---|
| 1,592,337 | 7/1926 | Cailloux et al. | 294/86.31 |
| 2,114,984 | 4/1938 | Anthony | 294/86.31 |
| 2,174,077 | 9/1939 | Bowen | 294/86.3 X |
| 2,313,263 | 3/1943 | Rea | 294/86.31 |
| 2,553,985 | 5/1951 | Siracusa | 294/86.3 |
| 2,567,337 | 9/1951 | Hunt | 294/86.31 |
| 2,743,130 | 4/1956 | Osmun | 294/86.3 X |
| 3,191,981 | 6/1965 | Osmun | 294/86.31 |
| 3,608,932 | 9/1971 | Brown | 285/315 X |
| 4,138,145 | 2/1979 | Lawrence | 285/23 |
| 4,246,967 | 1/1981 | Harris | 166/291 |
| 4,522,430 | 6/1985 | Stromberg | 285/24 |
| 4,524,998 | 6/1985 | Brisco | 285/101 |
| 4,566,168 | 1/1986 | Stromberg | 29/517 |
| 4,613,161 | 9/1986 | Brisco | 285/18 |
| 4,624,483 | 11/1986 | Stromberg | 285/24 |
| 4,850,622 | 7/1989 | Suzuki | 285/286 |
| 5,152,554 | 10/1992 | LaFleur | 285/88 |
| 5,207,459 | 5/1993 | Glover | 285/323 X |
| 5,282,653 | 2/1994 | LaFleur et al. | 285/110 |

FOREIGN PATENT DOCUMENTS

| | | | |
|---|---|---|---|
| 1143827 | 3/1985 | U.S.S.R. | 294/86.3 |

OTHER PUBLICATIONS

Brochure of LaFleur Petroleum Services, Inc., "Over-the-Collar" Kwik Koupler Operations & Maintenance Manual, pp. 1-7, with two Figure 1 drawings on General Arrangement-Cement Head and General Arrangement-Circulating Head.

*Primary Examiner*—Hoang C. Dang
*Attorney, Agent, or Firm*—Vaden, Eickenroht, Thompson & Feather

[57] ABSTRACT

There are disclosed several embodiments of an assembly for latching over and sealing about a casing joint having an enlarged diameter upper end so as to install a cementing head or other heavy equipment on the joint. The assembly includes a housing on which the equipment may be mounted and having a bore for lowering over the upper end of the casing joint to connect a bore in the equipment with the casing string. A latch ring is received in a recess in the bore for expansion to permit the upper end of the joint to be moved through and above it, and contraction beneath the lower side of the upper end, and a seal package is mounted in the recess above the ring to seal between the upper end of the casing joint and the recess.

22 Claims, 9 Drawing Sheets

LATCHING AND SEALING ASSEMBLY

This application is a continuation-in-part of my application Ser. No. 07/877,312, filed May 1, 1992, now abandoned.

This invention relates generally to apparatus for use in latching over and sealing about a tubular member. More particularly, it relates to an improved assembly for latching over and sealing about a tubular member which has an enlarged outer diameter at its upper end.

An assembly of this type has particular utility in the installation of large, heavy equipment, such as a cementing head, on the upper end of a casing joint at the upper end of a casing string for the purpose of circulating cement plugs through the casing string and into the annulus between it and the bore of a well. As well known in the art of drilling and completing wells, the casing string is made up of joints of casing each having an enlarged outer diameter, which may be a collar or an upset, forming a box for connection with the pin end of an adjacent joint. Conventionally, the joints are connected with their box ends up so that the pin ends may be stabbed into them as the joints are made up.

It has heretofore been the practice to install equipment of the type described on the upper end of the uppermost joint by means of a tubular connector known as a crossover sub having a lower threaded end of one size to connect with the box end of the casing joint and an upper threaded end of another size to connect with the equipment, thus permitting the plugs to be circulated from the head downwardly into the casing string. As will be understood, however, in view of the size and weight of the cementing head, it is difficult to make up such joints on the rig floor.

U.S. Pat. No. 5,152,554 shows an assembly of this general type comprising a housing having a bore therein of a size for lowering over the upper end of the casing joint, latch means mounted in a recess of the bore in position to latch about the casing joint beneath its enlarged upper end, when so received, and means in the recess for sealing between the recess and enlarged end of the joint when the latch means is in latching position.

In one form of the assembly, the latch means, made up of circumferentially spaced dogs, is normally expanded to permit it to be moved over the upper end of the casing joint and then contracted to a position beneath the upper end by manipulation of a lower end of the housing. In another form, the dogs are surrounded by an O-ring so as to normally assume a contracted position in which they are engaged with and forced outwardly to an expanded position by the upper end of the joint, and then permitted to return to contracted position about the joint beneath its upper end. In order to remove the assembly, the O-ring must be severed and the lower end of the housing moved downwardly to release the dogs to move outwardly and thus permit them to pass over the casing collar.

The primary object of this invention is to provide an assembly of this general type which, among other things, enables the latch means between latching and unlatching positions in a simple manner, which is of simpler and less expensive construction in other respects, including a short and thus space-saving profile, and which has certain safety features by which the operator may determine, from the outside of the assembly, if the latch means is in latching position, and which preferably enables the operator to insure that latch means cannot be moved to unlatching position without his intervention.

These and other objects are accomplished, in accordance with the illustrated embodiments of this invention, by an assembly of the type described comprising a housing on which the equipment may be mounted and having a bore therein adapted to receive the enlarged diameter of the casing joint or other tubular member as it is lowered thereover, and a recess about the bore having a downwardly and inwardly extending conical surface on which a latch means is mounted for sliding along the conical surface between an upper expanded position to pass the upper end of the casing joint and a lower contracted position to latch about the casing joint beneath its upper end. The latch means is caused to assume its lower contracted position in which it may be engaged and raised into its upper expanded position by the upper end of the casing joint, as the housing is lowered over the casing joint, whereby said upper end is free to move upwardly through and above the latch means following which the latch means may return to its lower contracted position beneath the enlarged upper end of the joint. More particularly, a means is mounted within the recess in the bore of the housing above the latch means for sealing between the upper end of the casing joint and the recess when it has moved upwardly through and above the latch means.

In the preferred embodiments of the invention, the latch means comprises an expandable and contractible ring which normally assumes its lower contracted position, and upper and lower, inwardly convergent, conical surfaces in the housing adjacent the upper and lower ends of the contacted ring define between them a vertical space less than the height of the ring so as to retain it on the conical surface in the recess. More particularly, a means is provided for moving the surfaces relatively toward one another so as to force the latch ring to slide along the conical surface of the recess to its upper expanded position, whereby the housing may be lifted from the casing joint, or, if desired, the housing may be lowered over the joint by engagement of the latch means with the upper end of the casing joint.

As illustrated, the upper, downwardly extending conical surface is formed on a retainer ring mounted in the housing above a correspondingly tapered conical surface on the upper end of the latch ring, and the latch ring is adapted to be raised by a sleeve slidably mounted in the bore of the body beneath the latch ring and having the lower conical surface formed on its upper end. In accordance with certain embodiments of the invention, the sleeve is raised to in turn raise the latch ring in response to the supply of pressure fluid from a source external to the housing to a pressure chamber formed between the body and sleeve. In another embodiment, the sleeve is raised by an arm rotatably mounted on the outside of the housing and connected with the sleeve by ribs which extend into the body.

In one embodiment of the invention, particularly well-suited for latching onto the upset upper end of a casing joint, the latch ring has a cylindrical surface which fits closely about the casing joint beneath its upset and has teeth formed thereon to grip and thereby resist vertical movement of the housing with respect to the casing joint. In other embodiments of the invention especially well-suited for latching over a collar at the upper end of a casing joint, the latch ring has an upwardly facing shoulder upon which the lower side of the collar may be supported.

The means for sealing about the upper end of the casing joint may comprise a pair of vertically spaced, cup-shaped seal rings each having an inner lip adapted to be deformed into tight engagement with the upper end. According to one embodiment of the invention, however, the sealing means comprises an annular packer having an inner diameter adapted to fit tightly about said upper end of the casing joint, and means responsive to raising of the latch ring for vertically stretching the packer so that its inner diameter will pass over the upper end of the casing joint and then, upon lowering of the latch ring, permitting the packer to vertically contract to cause its inner diameter to return to a position to fit tightly about said upper end. Preferably, the means for stretching the packing element comprises a lower ring secured to the housing and the lower end of the packer, an upper ring secured to the upper end of the packer and sealably slidable within the housing, and means such as one or more rods secured to the upper ring and extending through the packer and lower ring in position to be lifted by the latch ring as the supporting means is moved to its upper position.

In accordance with another novel aspect of the invention, the housing is of low profile in that it includes an upper section having an upwardly opening upper recess portion whose lower end is of a size to permit the sealing means to be installed therein, a lower section having a downwardly opening lower recess portion on which the conical surface is formed and whose upper end is of a size to permit the latch means to be installed therein when the latch means is in its contracted position, and means threadedly connecting the upper and lower housing sections to one another intermediate the sealing means and exterior of the housing. Preferably, the aforementioned upper retainer ring is held between the upper and lower housing sections in the recess to support the sealing means.

According to still another novel aspect of the invention, a rod is insertable from outside the housing to dispose its inner end in the recess only when the latch means is in such lower contracted position, thereby enabling the operator to make sure from outside the housing that the latch is in latched position about the casing joint. In its preferred embodiment, this position determining means also includes a bushing mounted on the outside of the housing in position to closely receive the rod, with the rod and bushing having lateral holes which are aligned to receive a pin therethrough only when the inner end of the rod is fully inserted into the recess. More particularly, the rod is inserted into a position above an upwardly facing surface on the latch means so that it prevents the latch means from being raised to its upper position.

In one embodiment of the invention, wherein an arm is mounted on the housing for rotation in one direction to lower the sleeve and in the other direction to raise the sleeve, the bushing is positioned to prevent arm rotation to its position to raise the sleeve, but is removable from the housing to permit the sleeve to be raised by the arm.

Preferably, the sleeve engages an inner cylindrical surface of the latch means, as it is raised to raise the latch means, so that the frictional force between them, due to the tendency of the latch means to return to its lower contracted position, resists rotation of the arm in the other direction and, thus, return of the assembly to latching position.

In the drawings, wherein like reference or characters are used throughout to designate like parts:

Figure 7:
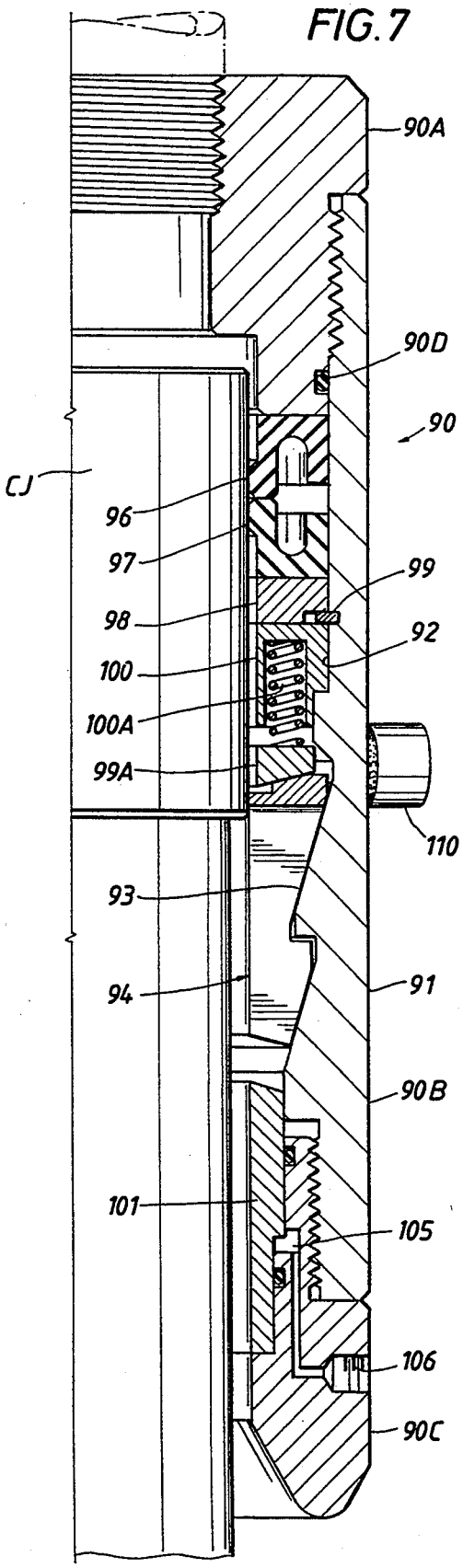
Figure 8:
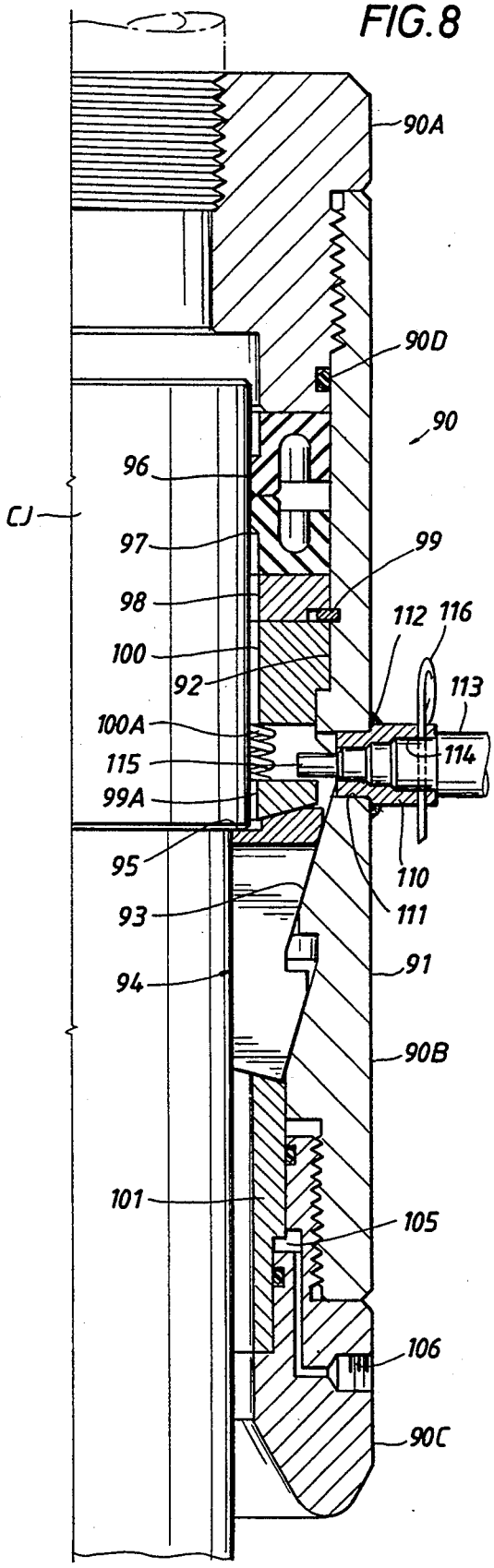
Figure 9:
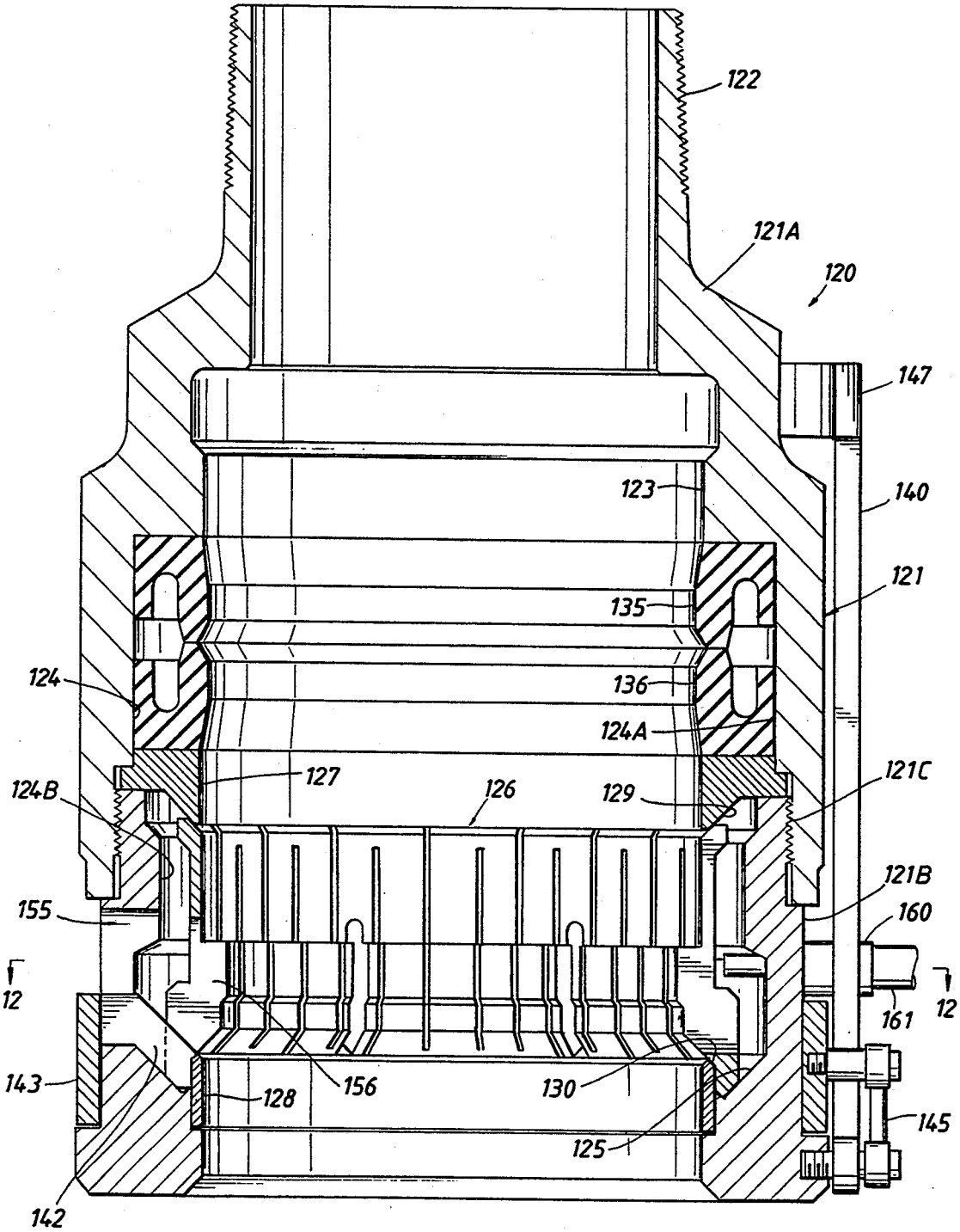
Figure 10:
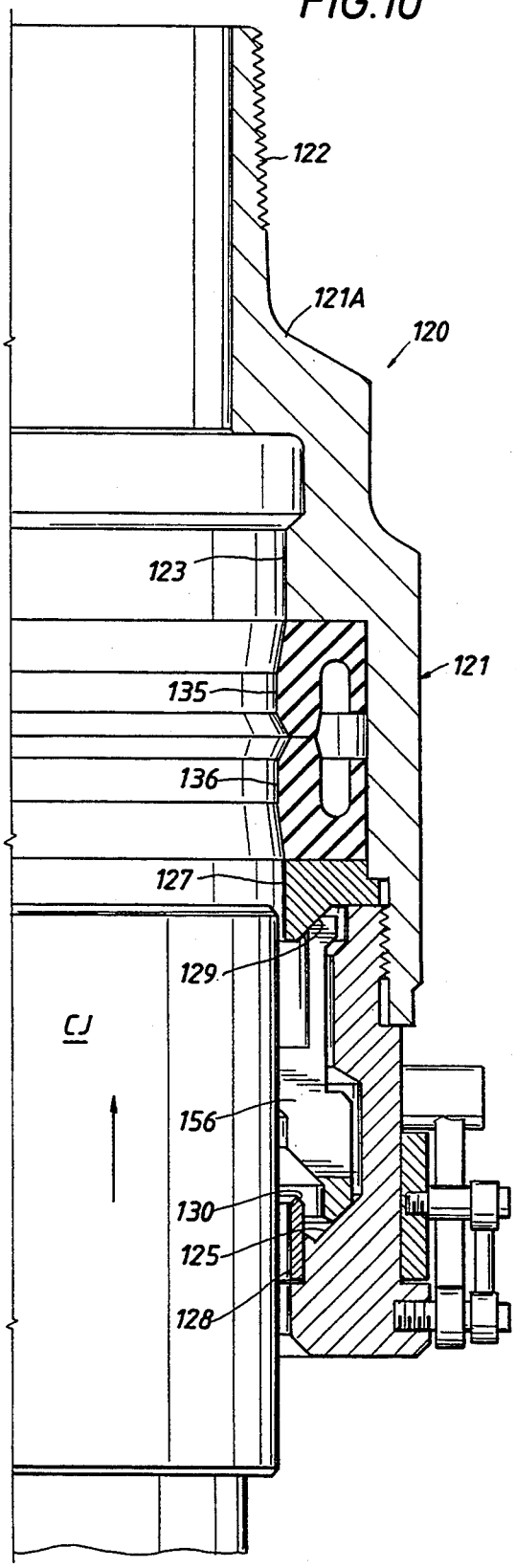
Figure 11:
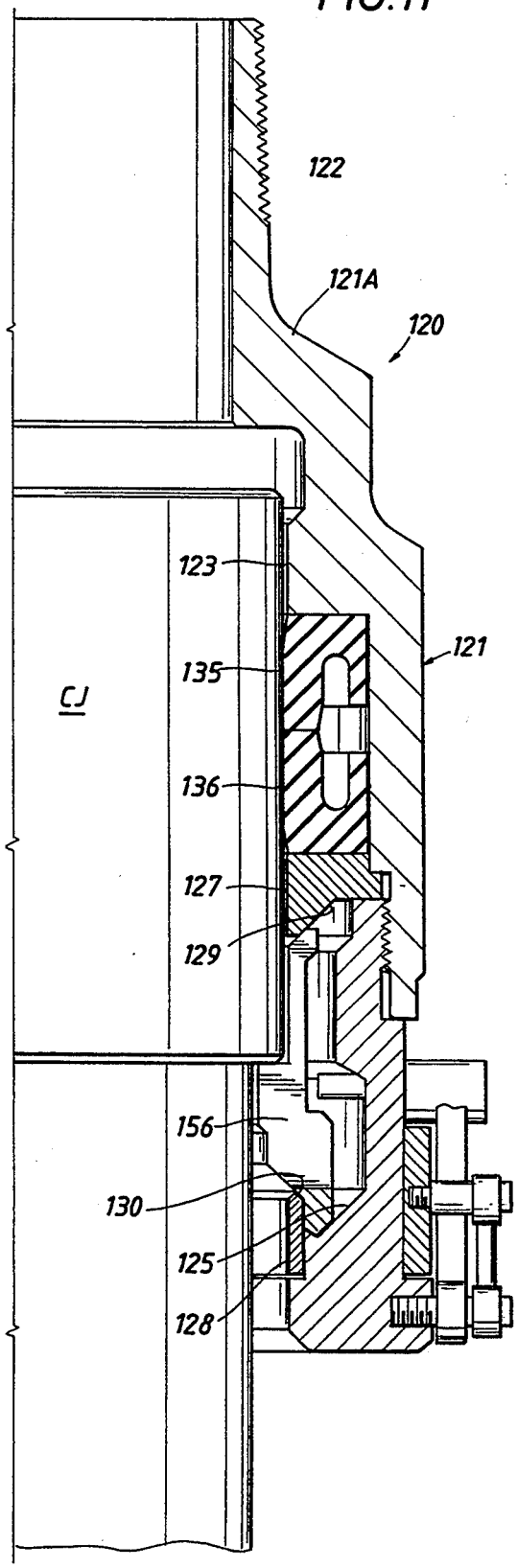
Figure 12:
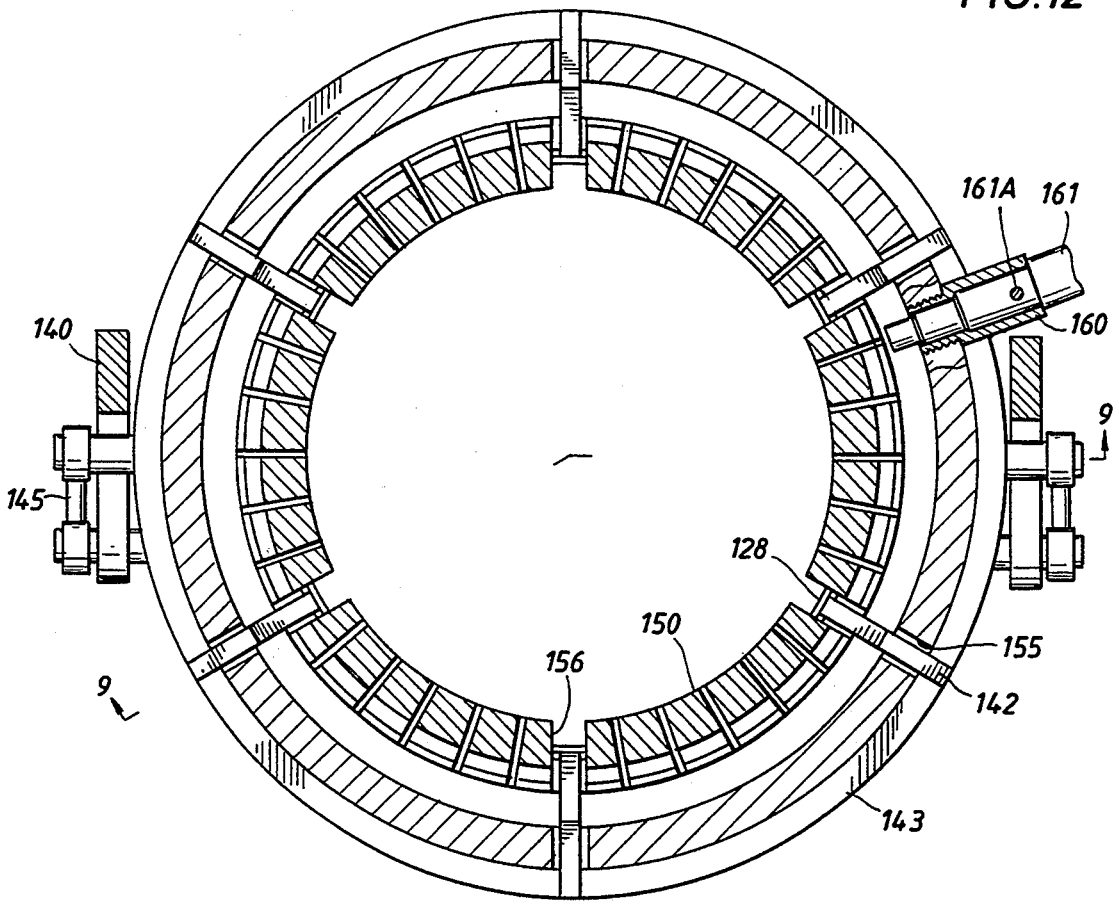
Figure 13:
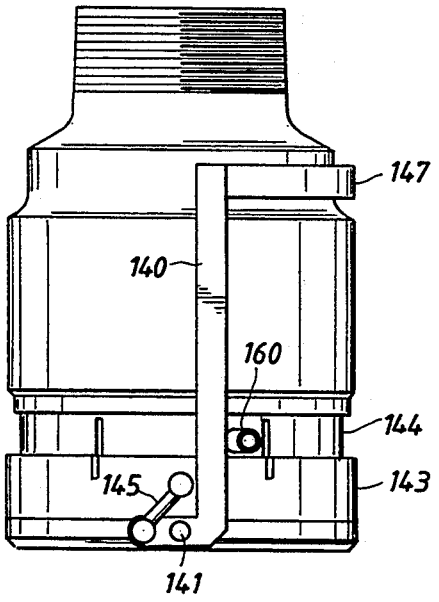
Figure 14:
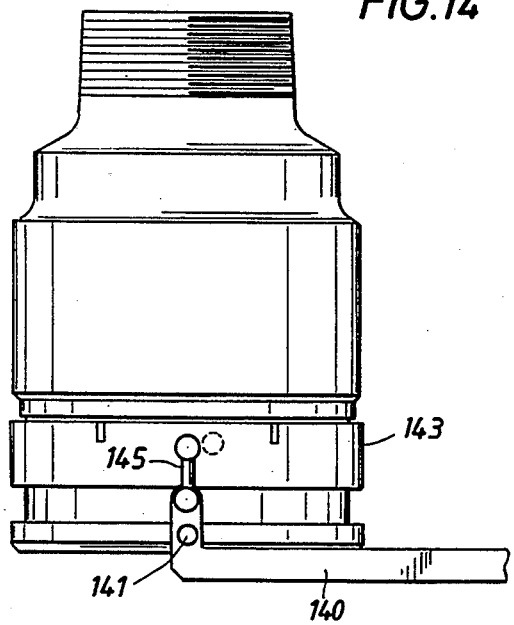
Figure 15:
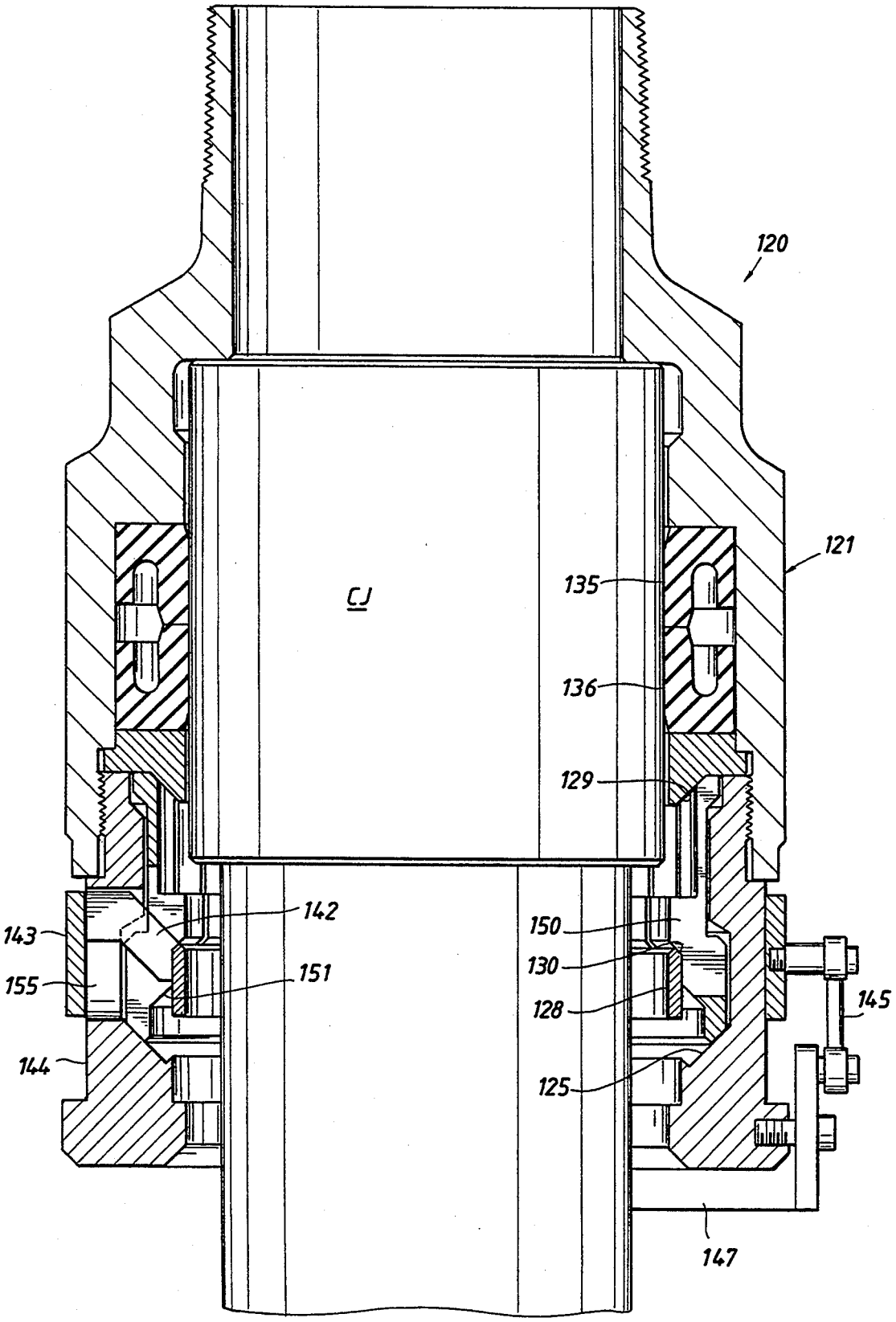

FIGS. 7 and 8 are half sectional views of still another embodiment of the latching assembly, showing, in FIG. 7, the assembly as it is lowered over the upper end of a casing joint, and, in FIG. 8, upon further lowering to a position in which the latch ring has moved downwardly to its contracted position beneath the upper end of the joint, following which a rod has been inserted into the recess of the housing to a position above the latch ring;

FIG. 9 is a full sectional view of a further embodiment of the assembly prior to lowering onto the upper end of a casing joint, and as seen along broken lines 9—9 of FIG. 12;

FIG. 10 is a half sectional view of the assembly of FIG. 9 as it is being lowered over the casing joint and showing the latch moved upwardly and outwardly to its expanded position by engagement with the upper end of the casing joint;

FIG. 11 is a view similar to FIG. 10, but upon lowering of the assembly to a position in which the latch ring has moved to a lower contracted position beneath the upper end of the joint and the upper end of the casing joint is sealably engaged with the seal package;

FIG. 12 is a cross-sectional view of the assembly when removed from the joint, and as seen along broken lines 12—12 of FIG. 9;

FIG. 13 is a side view of the assembly on a reduced scale and with an arm for raising and lowering the sleeve swung to a position to lower the sleeve and thus raise permit the latch ring to move to its lower contracted position, as shown in FIG. 9;

FIG. 14 is a view similar to FIG. 13, but with the arm swung to an essentially horizontal position to raise the sleeve and thus the latch ring to its upper expanded position; and FIG. 15 is a vertical sectional view of the assembly disposed over the casing Joint and with the sleeve raised to raise the latch ring to its upper expanded position in response to swinging of the arm to the position of FIG. 14.

Figure 1:
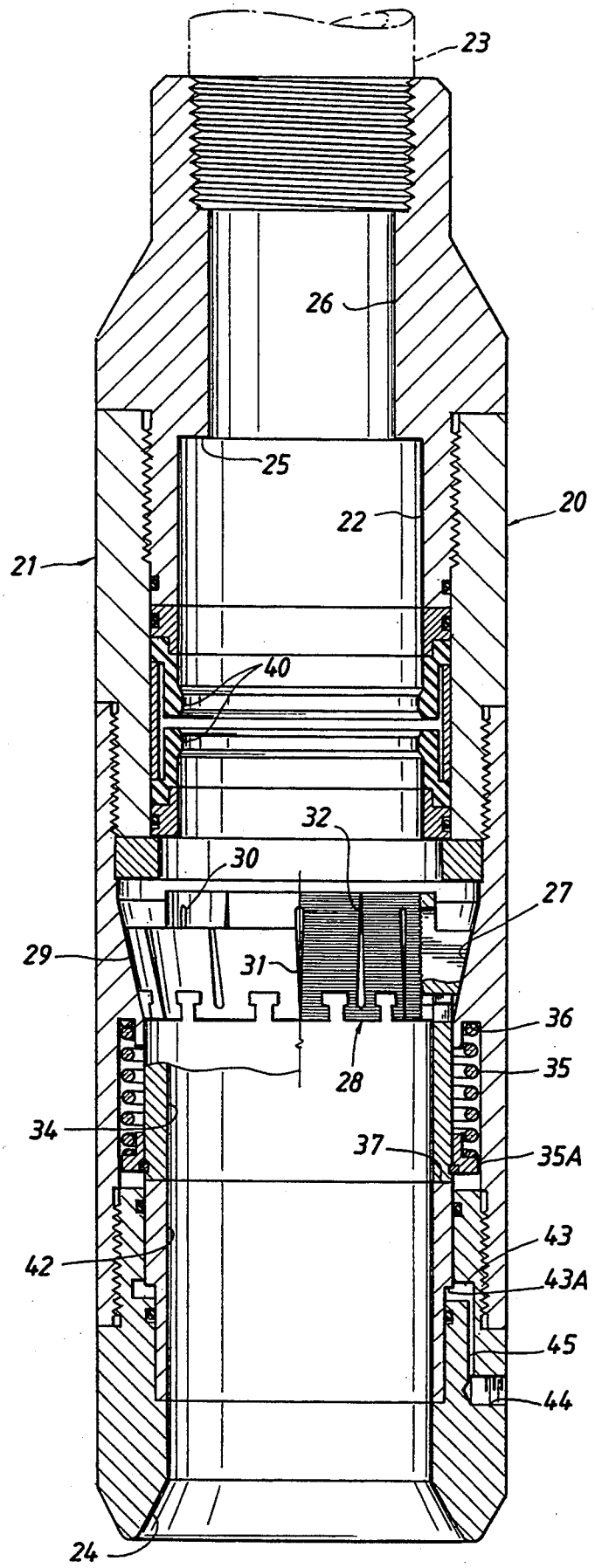
FIG. 1 is a vertical sectional view of a latching assembly constructed in accordance with one embodiment of the invention, prior to lowering over the upper end of a casing joint, and showing the latch ring for fitting closely about the joint partly in elevation and in its lower contracted position within the recess in the bore of the housing of the assembly.
Figure 2:
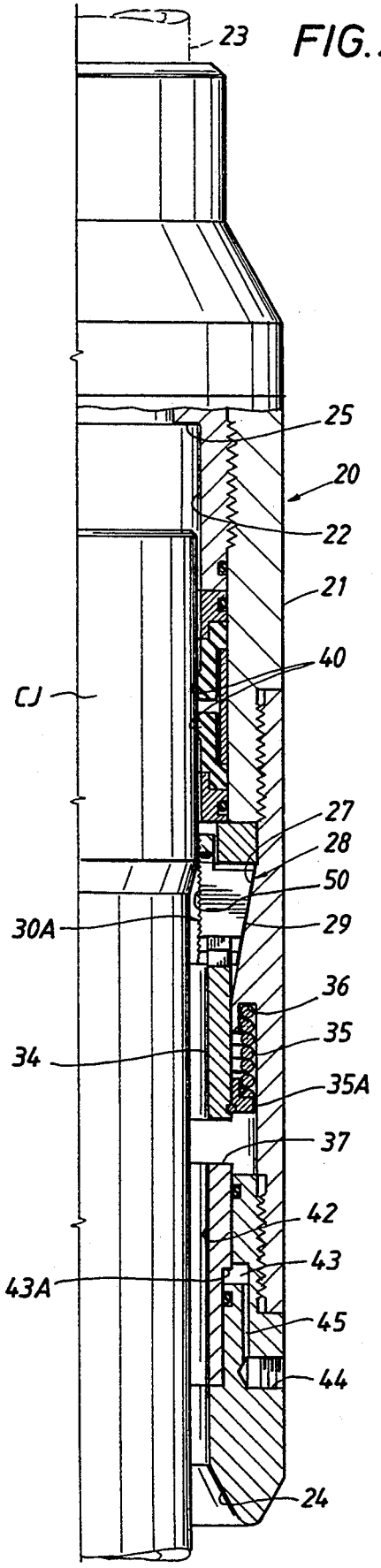
FIG. 2 is a half vertical sectional view of the assembly of FIG. 1 as it is lowered over the upper end of the joint to deform seal rings carried about the bore of the housing into sealing engagement with the upper end.
Figure 3:
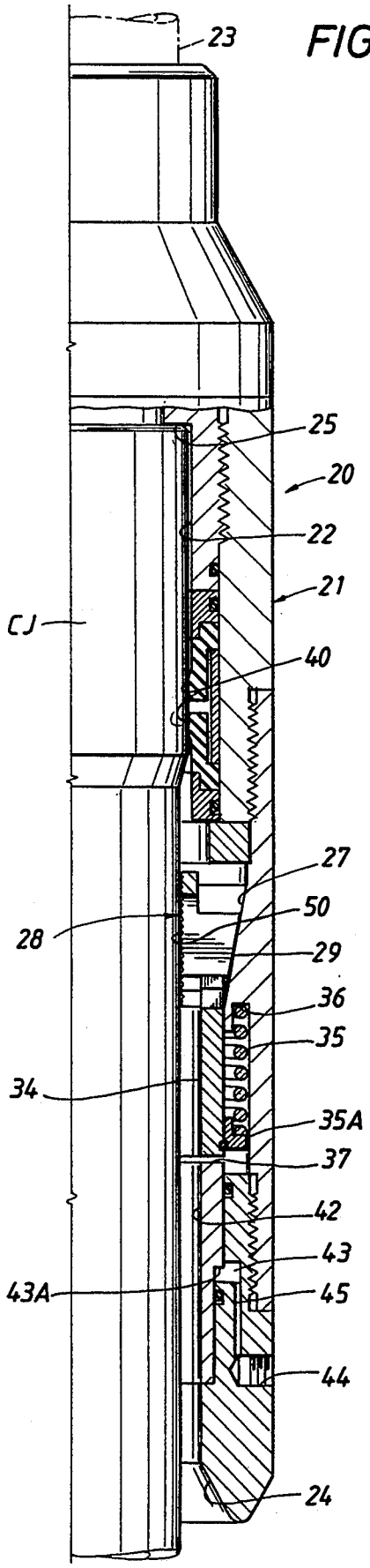
FIG. 3 is a view similar to FIG. 2, but upon further lowering of the housing of the assembly over the joint to permit the latch ring to be moved downwardly and inwardly within the recess into engagement with the casing joint beneath its upper end.

With reference now to the details of the above described drawings, the latching assembly shown in FIGS. 1 to 3, and indicated in its entirety by reference character 20, comprises a housing 21 having a bore 22 therethrough adapted to be lowered over the enlarged diameter upper end of a casing joint CJ. As shown, the housing has threads or other means at its upper end for connection to the lower end of a cementing head which is to be lowered on the upper end of the casing joint, and a lower outwardly flared end 24 so as to assist in lowering it over the upper end of the casing joint. A reduced diameter portion 26 of the upper end of the bore is adapted to form a continuation of the bore through the equipment mounted above the housing and the inner diameter of the casing joint to permit the free flow of objects, such as cementing plugs, therethrough. A shoulder 25 is formed in the housing at the intersection of the bore with the reduced diameter 26 for supporting the housing on the upper end of the joint.

A downwardly and inwardly tapered conical recess 27 is formed in the bore of the housing intermediate its upper and lower ends to receive an expandable and contractible latch ring 28 which has a downwardly and inwardly tapered outer surface 29 conforming with the taper of the recess 27 so as to guide the ring as it moves downwardly and inwardly between its upper expanded position, as shown in FIG. 2, and its lower contracted position, as shown in FIGS. 1 and 3. The ring has a bore 30 therethrough adapted, in its lower contracted position, to form a continuation of the bore 22 through the housing, and, in its upper expanded position, to form an upward continuation of the lower end of the bore. More particularly, the ring has slits 31 extending upwardly from its lower edge and slits 32 extending downwardly from its upper edge adjacent upwardly extending slits 31. These slits permit the ring to be moved downwardly from its normally expanded position toward a contracted position until the open ends of the slits are closed, thereby limiting further contraction of the ring.

The ring is located in its lower contracted position by means of a tubular member 34 vertically slidable within the bore of the housing and having T-heads beneath the ring and about its upper end received in T-slots in the lower edge of the ring. More particularly, the tubular member and thus the ring are yieldably urged downwardly by means of a coil spring 35 compressed between a collar 35A about the outer diameter of the sleeve 31 and the upper end 36 of a recessed portion in the housing in which the coil spring is received. Thus, in the position of the latching assembly shown in FIG. 1, the tubular member is urged downwardly into engagement with a shoulder 37 on the housing to in turn pull the ring downwardly into its contracted position.

A pair of vertically spaced, cup-shaped seal rings 40 are carried about the bore 22 of the housing above the ring 28 in position to sealably engage about the enlarged upper end of the casing joint when the housing has been latched over the upper end of the joint, as shown in FIG. 3. For this purpose, the inner diameters of the lips on the ends of the seal rings are adapted to be deformed into tight engagement about the upper end of the casing joint, with the upper ring opening downwardly and the lower lip opening upwardly so that pressure either above or below will cause one lip to be urged into tighter engagement about the upper end of the casing joint.

As previously described, the ring 28 is adapted to be moved upwardly to its expanded position by means of a sleeve 42 which is vertically slidable within the bore of the housing beneath the lower end of the tubular member 34. More particularly, the sleeve has an upper enlarged and a lower reduced outer diameter sealably engagable with the housing to form a pressure chamber 43 between it and the housing which includes a downwardly facing pressure-responsive surface 43A on the sleeve 42. Consequently, pressure fluid may be introduced through the port 44 and the passageway 45 in the housing into the chamber 43 for urging the sleeve upwardly, and thus moving the tubular member 34 upwardly to lift the ring 28 into its upper expanded position within the recess 27. This pressure fluid may be supplied to the chamber from any suitable source external to the assembly.

As previously described, and as will be understood from FIG. 1, the inner diameter of the ring is less than the upper end of the casing joint CJ, such that, with the ring occupying its lower contracted position, its lower end will be engaged by the upper end of the casing joint as the housing is lowered over the casing joint. Continued lowering of the housing over the casing joint will thus cause the ring to slide upwardly and outwardly within its recess and toward its expanded position to permit the upper enlarged end of the casing joint to be moved through and above the ring and into the outwardly deformed inner diameters of the seal rings 40, as shown in FIG. 2. Then, as the assembly is lowered further to the position of FIG. 3, the upper end of the ring 28 moves beneath the upper end of the casing joint to permit it to be yieldably urged inwardly downwardly to its lower position by expansion of the coil spring 35, which was contracted as the ring was lifted to the position of FIG. 3.

As shown, the upper end of the casing joint comprises an upset, and the ring 28 has teeth or wickers 50 formed about its bore for gripping the casing joint beneath the upset and thus resisting vertical movement of the housing of the assembly with respect to the casing joint. Also, of course, upward movement of the ring 28 with the latching assembly housing would be resisted by engagement of its upper edge with the upset at the upper end of the casing joint.

In order to remove the latching assembly from the casing joint, pressure fluid may be applied to the chamber 43 so as to lift the sleeve 42 which in turn lifts the tubular member 34 and thus the ring 28 to cause it to be moved upwardly and outwardly within its recess to its expanded position, as shown in FIG. 1. In this position, of course, the latching assembly may be lifted from the casing joint. Sleeve 42 may also be raised to lift the ring 28 to its upper expanded position to facilitate lowering of the housing of the latching assembly over the casing joint by permitting its bore to be moved easily over the upper end of the casing joint until it had moved into sealing engagement with the seal rings, at which time the pressure fluid would be vented to permit the ring to be moved downwardly by the coil spring 35 to its contracted position.

Figure 4:
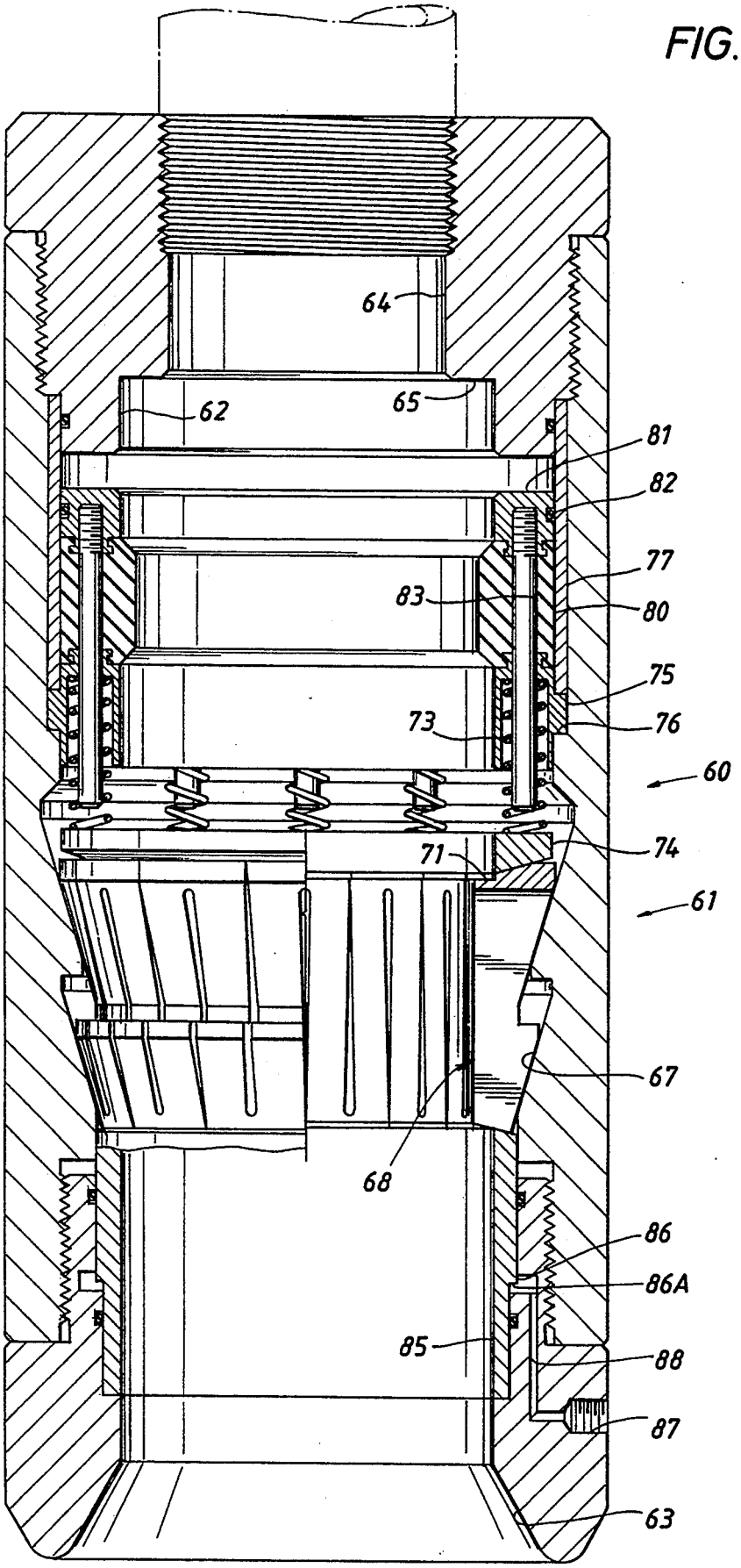
FIG. 4 is a vertical sectional view of another embodiment of the latching assembly, prior to lowering of its housing over the upper end of the casing joint, and showing the latch ring partly in elevation and in its lower, contracted position within the recess in the bore of the housing.
Figure 5:
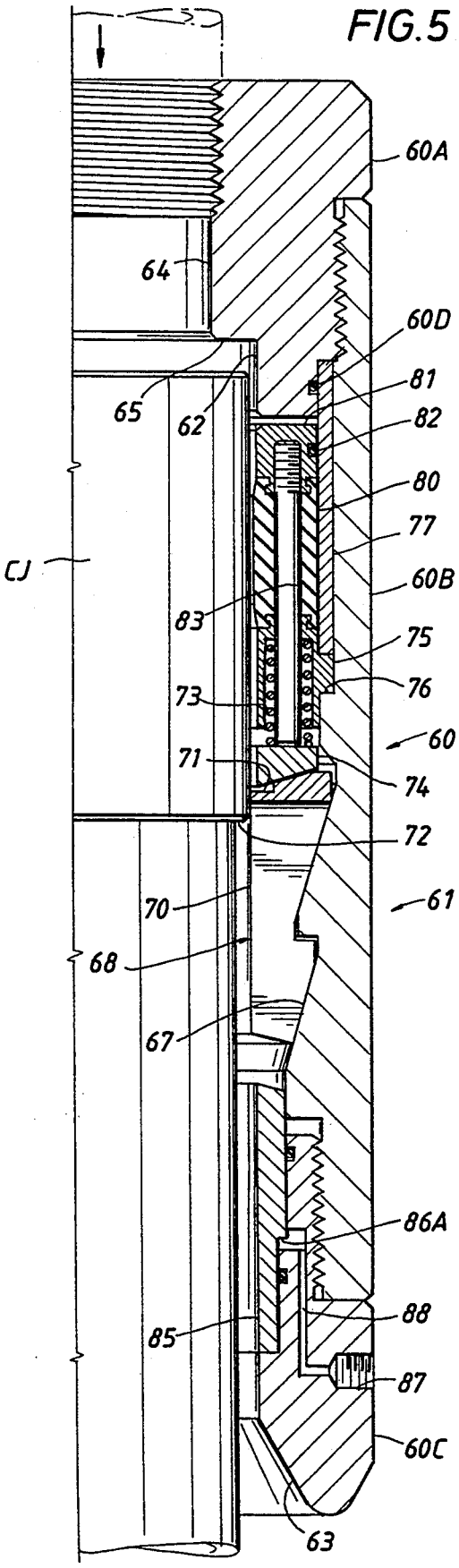
FIG. 5 is a half vertical sectional view of the assembly of FIG. 4 as the housing is lowered over the end of the casing joint, and with the ring in its raised, expanded position so as to vertically stretch a packer mounted in the bore of the housing above the ring and thus cause its inner diameter to be expanded into a position to permit said upper end to be moved upwardly therethrough.
Figure 6:
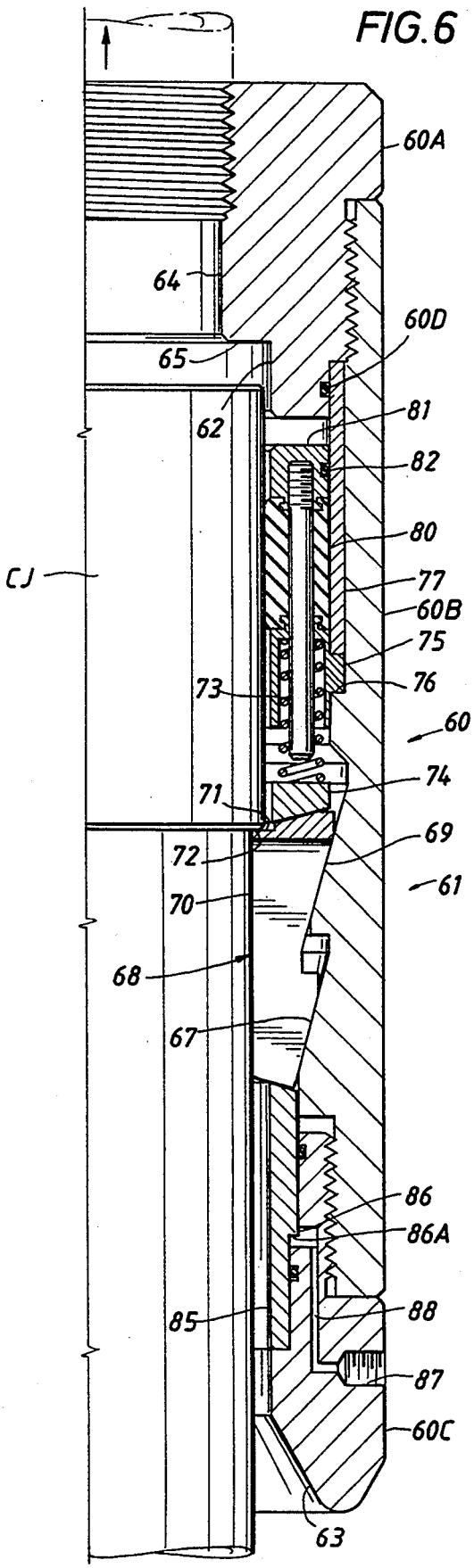
FIG. 6 is a view similar to FIG. 5, but upon further lowering of the housing about the upper end of the casing joint to permit the ring to be moved downwardly to its contracted position beneath the lower side of the upper end, and the packer to contract and thus cause its inner diameter to fit tightly about the outer end of the casing joint.

The second described embodiment of the latching assembly, which is indicated in its entirety in FIGS. 4–6 by reference character 60, is similar in many respects to that of the above described embodiment of the assembly. Thus, it also includes a housing 61 having a bore 62 therethrough to receive the enlarged outer diameter upper end of a casing joint CJ. Also, and as in the case of the assembly 20, the lower end 63 of the housing bore is flared outwardly for guiding it over the upper end of the casing joint, and a reduced diameter portion 64 formed in the upper end of its bore forms a continuation of the bore through the equipment and the inner diameter of the casing joint. Also, and again as in the first described embodiment, a downwardly facing shoulder 65 intermediate the bore 62 and the portion 64 is adapted to engage with the upper end of the casing joint as the housing is lowered thereover, thus limiting such downward movement.

In the embodiment of FIGS. 4–6, there is a recess 67 in the bore which has a pair of downwardly and inwardly tapered conical surfaces, and a radially expandable and contractible ring 68 received in the recess has outer surfaces 69 which are similarly tapered conical surfaces for sliding thereover and an inner diameter which, in the upper expanded position of the ring, is adapted to form a continuation of the lower end of the bore through the housing so as to permit the ring to be moved downwardly over the upper end of the casing joint. The ring 68 is of basically the same construction as the ring 28 of the first described embodiment, except for the fact that it has a pair of double conical surfaces on its outer side for sliding downwardly and inwardly along the surfaces of the recess 67. Also, the bore through the ring is not serrated, but instead has an upwardly facing shoulder 71 upon which a downwardly facing shoulder 72 on the lower side of a collar at the upper end of the casing joint is adapted to seat, as shown in FIG. 6.

Also, the ring is yieldably urged to its lower contracted position by means of a coil spring 73 which is compressed between a ring 74 supported on the upper end of the ring outwardly of its shoulder 71 and another ring 75 which is held downwardly on an upwardly facing shoulder 76 of the housing by means of a tubular member 77 whose upper end is held downwardly by a shoulder of the housing. Thus, the coil spring 73 functions similarly to the coil spring of the first described embodiment in that it yieldably urges the ring 68 to its lower contracted position, and thus to a position in which its lower end is adapted to be engaged by the upper end of the casing joint when the ring is in its lower position. This then will lift the ring upwardly within the recess, as shown in FIG. 5, to permit the upper end of the casing joint to be moved through and above the ring, as shown in FIG. 6.

When the housing has been lowered to this position, the upper end of the casing joint is adapted to be sealably engaged by an annular packer 80 of elastomeric material which is anchored at its lower end to the ring 75 and at its upper end to another ring 81 carrying an O-ring 82 about its outer diameter for sealably sliding within the bore of the housing outwardly of the bore 62. More particularly, and for reasons to be described, rods 83 threadedly connected at their upper ends to the ring 81 extend downwardly and closely through holes in the packer 80 and through the lower ring 75 to dispose their lower ends above the ring 74.

The inner diameter of the packer in its relaxed state, as shown in FIGS. 4 and 6, is less than the outer diameter of the upper end of the casing joint so as to tightly engage the outer enlarged diameter when the housing of the assembly has been moved downwardly over the casing joint, as shown in FIG. 6. However, as the assembly is moved downwardly over the casing joint, and the lower end of the ring 68 has engaged and lifted by the upper end of the casing joint to permit the casing joint to be moved therethrough, as shown in FIG. 5, the ring 74 is lifted with the ring 68 so as to, in turn, engage and lift the rods 83, and thus lift the upper ring 81 with respect to the ring 75. This then will vertically stretch the packer so that, as shown in FIG. 5, its inner diameter is increased to permit it to be moved freely over the upper end of the casing joint.

Then, however, as the housing continues to be moved downwardly over the casing joint, until the shoulder 71 on the upper end of the ring 68 is beneath the lower side 72 of the collar of the casing joint, the ring 68 is moved inwardly and downwardly by the coil spring 73, which in turn permits the packer to return to its relaxed state in which its inner diameter tightly engages about the upper end of the casing joint.

More particularly, the upper ring 81 is urged downwardly by a force equal to the pressure of fluid in the bore of the housing above it times the cross-sectional area defined between the upper end of the casing joint and the seal ring 82. Since this area is greater than the cross-sectional area of the packer less the cross-sectional area of the rod, the sealing engagement of the packer with the upper end of the casing joint is pressure-energized. That is, pressure with which the packer engages the upper end of the casing joint is greater than that in the bore of the housing and, thus, that which it contains.

As in the case of the first described embodiment, a sleeve 85 vertically reciprocable within the bore of the housing beneath the ring 68 has relatively enlarged and reduced diameter upper and lower ends which are sealably slidable within the housing to form a pressure chamber 86 including a downwardly facing pressure-responsive surface 86A of the sleeve 85. As previously described, pressure fluid may be introduced into the chamber through a port 87 leading to a passageway 88 connecting with the chamber to force the sleeve upwardly to engage and thus raise the ring. As in the case of the first embodiment, this piston sleeve may be used not only to permit the assembly to be removed from the upper end of the casing head, but also to initially raise the ring 68 to a position in which it may be lowered over the enlarged upper end of the casing joint during assembly.

As shown, the lower end of ring 74 forms a downwardly and inwardly and opened conical surface adjacent a corresponding tapered surface on the upper end of ring 68, and the upper end of sleeve 85 forms an upwardly and inwardly tapered conical surface which, in the raised position of the sleeve, is adjacent a similarly tapered surface on the lower end of the ring. As shown, these surfaces on ring 74 and sleeve 85 form a vertical space therebetween which is less than the vertical height of the latch ring to retain it within the recess. On the other hand, as the latch ring is raised by the sleeve, these surfaces force the latch ring to move inwardly to its contracted position as it slides over the conical surface of the recess 67.

As shown, the housing of the latching assembly 60 is made up of upper, lower, and intermediate sections threadedly connected to one another. Thus, the lower end of upper section 60A is threaded to the upper end of the intermediate section 60B to form the upper end of the recess in the bore of the housing. The lower housing section 60C is in turn threadedly connected to the lower end of the intermediate section to form the lower end of the recess. The above described packer and its associated parts are received in the recess formed by the inner diameter of the intermediate section, and the sleeve 62 is slidable within an enlarged inner diameter of the lower housing section. A seal ring 60D seals between the lower end of the upper housing section and the sleeve 77 to prevent the loss of pressure from the space above the packer and the upper end of the casing joint.

The embodiment of the latching assembly shown in FIGS. 7 and 8, and indicated in its entirety by reference character 90, is similar in many respects to the sealing assembly 60. Thus, among other things, it is made up of a housing 91 having upper, intermediate and lower sections 90A, 90B and 90C forming a recess 92 in the bore through the housing, and an O-ring 90D sealing between sections 90A and 90B. In addition, the lower end of the recess has a pair of conically shaped surfaces 93 on which a latch ring 94 is mounted for sliding over the conical surface 93 in the recess. The ring 94 is similar in construction to the ring 68 in that it has slits in its upper and lower edges to permit it to be expanded and contracted, and is urged downwardly to its inner expanded position shown in FIG. 8. Thus, a ring 100 held downwardly by a split ring 99 against a shoulder in the recess 92 receives coil springs 100A which bear upon a ring 99A to hold it engaged with the upper end of latch ring 94.

As described in connection with the embodiment of FIGS. 5–6, upon movement of the housing downwardly over the upper end of the casing joint CJ, the latch ring 94 is moved upwardly and outwardly to its upper expanded position, as shown in FIG. 7. As the housing moves further downwardly to the position of FIG. 8, a ledge or shoulder 95 on the upper end of the ring 94 moves inwardly to a position beneath the lower end of the upper enlarged collar of the casing joint CJ. At the same time, the collar has moved into and sealably engaged with the inverted sealing lips 96 and 97 mounted in the upper end of the recess above a ring 98 held vertically within the recess by a split ring 99. As shown, and similarly to the sealing means described in the embodiment of FIGS. 1–4, these packings form a seal between the collar of the casing joint and the recess beneath the O-ring 90D sealing between the upper and intermediate housing sections.

As was also the case in the embodiment of FIGS. 5 and 6, the latch ring 94 is adapted to be raised to its upper expanded position by means of a sleeve 101 vertically slidably mounted in the lower end of the recess of the housing. Thus, pressure fluid may be supplied to the chamber 105 from an external source through port 106.

The upper and lower ends of the latch ring have inwardly convergent conical surfaces at their upper and lower ends, and the ring 99A and the upper end of the sleeve 101 have correspondingly tapered conical surfaces on their lower and upper ends, respectively, to define a vertical space between them which is less than the vertical height of the latch ring in its lower contracted position, thus retaining the latch ring within the recess. As was also true in the prior embodiment, upon raising of the latch ring, in response to raising of the sleeve 101, the tapered surfaces on the upper and lower ends of the sleeve and retainer ring will force the latch ring to its outer expanded position as it moves upwardly and outwardly along the conical surfaces of the recess.

In accordance with yet another of the novel aspects of the present invention, a bushing 110 extends into a hole 111 in the housing opposite the recess above the latch ring 93 when the ring is in its lower contracted position (FIG. 8). As shown, the bushing is welded to the housing at 112 and is so located that a rod 113 may be passed through the opening 114 in the bushing to dispose its inner end 115 above the retainer ring 99A, and thus above the latch ring 94, when the latch ring is in its lower contacted position. As previously mentioned, this enables the operator to determine that the latch ring is in its lower position, and hence that the latching assembly has been moved downwardly into latching position over the upper end of the casing joint CJ. At the same time, the disposal of the inner end 115 of the rod above the latch ring prevents the latch ring from being moved upwardly to its upper expanded position, and thus to a position in which it would not be retained on the casing joint CJ.

As also shown in FIG. 8, aligned lateral holes are formed in the outer end of the bushing and through the rod 113. More particularly, these holes are aligned only when the rod is fully inserted into the bushing, and thus with its inner end above the latch ring. The rod is then held in its fully inserted position by means of a pin or key 116 which is passed through the aligned holes.

As previously described, in the latching assembly 120 of FIGS. 9–15, the housing 121 has a shorter profile and is of even more simplified construction than the previously described embodiments. Furthermore, it has a latch ring which is moved between latching and unlatching position by means of a mechanism which is manually operated and hence does not require supply and exhaust of pressure fluid, as will be fully understood from the description to follow.

The upper end of the housing has threads 122 thereabout, rather than the internal threads in the prior described embodiments, for connection with equipment above it. The bore 123 of the housing has a recess 124 thereabout which in turn has a downwardly and inwardly tapered conical surface 125 at its lower end. As shown, the bore 123 is formed in an outwardly enlarged internal diameter of the housing so that, when the housing is disposed over the casing joint CJ, the upper end of the bore will form an upward continuation of the inner diameter of the casing joint.

A latch ring 126 is mounted within the lower end of the recess for sliding over the conical surface 125 of the recess between the inner contracted position, shown in FIG. 9, and the outer expanded position, shown in FIG. 10. The latch ring is of essentially the same construction as the latch ring of the embodiment of FIGS. 5 and 6 and 7 and 8, except that it is so constructed that it normally assumes its inner contracted position shown in FIG. 9, where its lower end is positioned to be engaged by the upper end of the casing string, as the housing is lowered over the casing string, without the need for springs or the like to urge it to its inner contracted position.

As shown, the latch ring is retained in its lower contracted position by means of a retainer ring 127 at its upper end and a sleeve 128 at its lower end which is vertically slidable within an enlarged inner diameter in the bore of the housing at the lower end of the recess. More particularly, the retaining ring 127 has a downwardly and inwardly tapered conical surface 129 at its lower end which is adjacent a similarly tapered surface on the upper end of the latch ring. The upper end of the sleeve 128 has an upwardly and inwardly tapered conical surface 130 at its upper end adjacent a similarly tapered surface near the lower end of the latch ring. More particularly, these tapered retaining surfaces on the ring 127 and sleeve 128 form a vertical space between them which is less than the vertical height of the latch ring so as to retain the latch ring within the recess.

As in the case of the prior described embodiments of the latching assembly, the raising of the ring 128 from its lower to its upper position will in turn raise the latch ring and cause it to slide upwardly along the conical surface 125 to its outer expanded position. More particularly, the conically shaped surfaces on the upper end of the sleeve and lower end of the latch ring 127 apply an outward force to the latch ring to move it to its outer expanded position.

As in the case of the embodiment of FIGS. 7 and 8, a pair of inverted U-shaped seal rings 135 and 136 are mounted in the recess above the ring 127 in position to sealably engage the collar about the casing joint as the latching assembly is moved downwardly over the upper end of the casing joint, as shown in FIGS. 10 and 11. That is, as the latching ring is moved upwardly and outwardly by engagement with the upper end of the collar, the collar continues to move upwardly from the position of FIG. 10 to the position of FIG. 11 to a position oppositely the seal rings 135 and 136, which thus form a seal between the collar and the upper end of the recess.

As also previously mentioned, the housing 121 is of very simplified construction in that it merely comprises upper and lower housing sections 121A and 121B which are threadedly connected to one another at 121C at a position beneath the lower end of the sealing means, and thus intermediate the sealing engagement of the sealing means with the casing joint and the exterior of the housing. As also previously described, the upper housing section has an upper recessed portion 124A which receives the sealing rings 135 and 136 as they are moved upwardly through the lower end of the housing section 121A, and a lower recess portion 124B in the lower housing section 121B permits the latch ring to be moved downwardly into it when the latch ring is in its inner collapsed position. Upon assembly of the sealing rings and latch ring in the manner described, the retainer ring 127 is placed between the oppositely facing surfaes on the upper and lower housing sections so as to be retained in the position shown upon threaded makeup of the housing sections. Thus, as previously described, the ring 127 is positioned not only to support the seal rings 135 and 136 within the recess, but also to form the upper retaining surface for the latch ring in the inner contracted position of the latch ring.

As previously described, the sleeve 128 is adapted to be raised from its lower position of FIG. 9 to its upper position of FIG. 15, in order to move the latch ring 126 to its outer expanded position, by means of an arm 140 which is rotatably mounted on the outer side of the housing near its lower end by means of pins 141. The arm is connected to the sleeve by means of ribs 142 extending between the sleeve and a ring 143 surrounding a recessed portion 144 of the outside of the housing and connected to the arm by links 145. More particularly, and as shown, the arm includes elongate sides 146 each having a bent end pivotally connected to the pivot pins 141, and an arcuate handle 147 extending between the ends of the elongate portions 146 and which, in the position of the arm shown in FIG. 13, wherein the sleeve 128 is in its lower position, is disposed close to one side of the upper end of the housing. Thus, as the arm is swung between positions to raise and lower the sleeve, the elongate portions 140 are moved between essentially vertical positions in order to lower the sleeve (FIG. 13) and essentially horizontal portions (FIG. 14) to raise the sleeve.

In order to add to the mechanical advantage of the arm, particularly for the purpose of holding the sleeve in its upper position in order to in turn hold the latch ring in its upper expanded position, as shown in FIG. 15, the bent pivot pins 141 extend through intermediate portions of the ends of the elongate portions and the links 145 are pivotally connected at one end to the outer ends of the bent ends and at the other end to ring 143. Thus, as shown in FIG. 14, when the sleeve 128 is raised, the bent end of the elongate portions and the links 145 are essentially aligned.

As also shown in the drawings, the inner side of the latch ring 150 above the lower conical surface on the latch ring has a cylindrical surface 150 against which the inner side of the sleeve 128 is engaged in its upper position (FIG. 15). Thus, as the sleeve is raised to in turn raise the latch ring, its upper conical surface 130 will continue to slide along the lower conical surface of the latch ring, and then move upwardly into the enlarged diameter portion of the inner side of the ring to slide into a position adjacent the cylindrical surface 150. In this position of the ring, its upper conical end 130 will engage a lower conical surface of the latch ring above the cylindrical surface 150, and, due to the tendency of the latch ring to move inwardly to its contracted position, will frictionally resist downward movement of the latch ring, thus supplementing the mechanical advantage of the operating arm to retain the sleeve in its upper position, as may be desirable during either assembly of the housing over the casing joint or removal of the housing from over the casing joint.

As shown, the ribs 142 are received through slots 155 in the housing and the aligned slots 156 about the lower side of the latch ring, these slots, of course, being in addition to the thin slots which extend downwardly from its upper edges and upwardly from its lower edges to enable the ring to be expanded and contracted.

As in the embodiment of the invention illustrated in FIGS. 7 and 8, the embodiment of FIGS. 9–15 also includes a means which permits the operator to determine that the sleeve is, in fact, in its lower position. For this purpose, a bushing 160, similar to the bushing described in connection with the embodiments of FIGS. 7 and 8, is connected to and extends into the housing to provide an opening therethrough in which a rod 161 may be received with its inner end extending into the housing, as shown in FIG. 9. Thus, if the operator is able to fully insert the rod, he knows that the sleeve and the latch ring are in their lower positions. More particularly, since the sleeve extends above an upwardly facing surface of the latch ring, as shown in FIG. 9, the full insertion of the rod also prevents the latch ring from being raised to its upper expanded position.

As was also the case of the position-determining means of FIGS. 7 and 8, the bushing and rod are provided with aligned lateral holes which receive a pin 161A only when the pin is fully inserted, as shown in FIG. 12.

As compared with the position-determining means of FIGS. 7 and 8, the bushing 160 is threadedly and thus releasably connected to the housing to permit its removal therefrom. Thus, as shown in FIG. 13, when in place, the bushing 160 prevents the arm from swinging downwardly, and thus prevents the sleeve from raising the latch ring to its inner contracted position. On the other hand, as shown in FIG. 14, upon removal of the bushing, the arm may be swung in a counterclockwise direction to its essentially horizontal position to permit the latch ring to be raised with the sleeve, as shown in FIG. 15.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An assembly for latching over and sealing about a tubular member having an enlarged diameter upper end, comprising a housing having a bore therein to receive the upper end of the member as it is lowered thereover and a recess thereabout having a downwardly and inwardly extending conical surface, latch means mounted in the recess for sliding along the conical surface between an upper expanded position to pass the upper end of the member and a lower contracted position to fit closely about the member beneath said upper end, said latch means being normally disposed in its lower position in which it may be engaged and raised into its upper position by the upper end of the member, as the housing is lowered over the member, whereby said upper end is free to move upwardly through the latch means and then permit the latch means to return to its lower position beneath said upper end, means mounted within the recess of the housing above the latch means for sealing between the recess and the member beneath its upper end when it has moved upwardly through the latch means, and means for raising the latch means from its lower to its upper position in response to the supply of pressure fluid thereto from a source external to the housing.

2. An assembly of the character defined in claim 1, wherein said raising means comprises a sleeve slidably mounted within the bore of the housing beneath the recess to form a pressure chamber therebetween having a downwardly facing pressure responsive surface, and means for selectively supplying said fluid to the chamber to lift the sleeve and thus the latch means from its lower position.

3. An assembly for latching over and sealing about a tubular member having an enlarged diameter upper end, comprising a housing having a bore therein to receive the upper end of the member as it is lowered thereover and a recess thereabout having a downwardly and inwardly extending conical surface, latch means mounted in the recess for sliding along the conical surface between an upper expanded position to pass the upper end of the member and a lower contracted position to fit closely about the member beneath said upper end, said latch means being normally disposed in its lower position in which it may be engaged and raised into its upper position by the upper end of the member, as the housing is lowered over the member, whereby said upper end is free to move upwardly through the latch means and then permit the latch means to return to its lower position beneath said upper end, and means mounted within the recess of the housing above the latch means for sealing between the recess and the member beneath its upper end when it has moved upwardly through the latch means, said sealing means comprises an annular packer having an inner diameter adapted to fit tightly about the member beneath said upper end, and means responsive to raising of the latch means for vertically stretching the packer so that its inner diameter will pass over the upper end of the member and then, upon lowering of the latch means, permitting the packer to vertically contract to cause its inner diameter to return to a position to fit tightly about said member beneath said upper end.

4. An assembly of the character defined in claim 3, wherein said means for stretching the packer comprises a lower ring secured to the housing and the lower end of the packer, an upper ring secured to the upper end of the packer and sealably slidable within the housing, and means secured to the upper ring and extending through the packer and lower ring in position to be raised by the latch means as the latch means is moved to its upper position.

5. An assembly for latching over a tubular member having an enlarged diameter upper end, comprising a housing having a bore therein to receive the upper end of the tubular member as it is lowered thereover and a recess thereabout having a downwardly and inwardly extending conical surface, latch means mounted in the recess for sliding along the conical surface between an upper expanded position to pass the upper end of the member and a lower contracted position to fit closely about the member beneath said upper end, means yieldably urging the latch means toward its lower position in which it may be engaged and raised into its upper position by the upper end of the member, as the housing is lowered over the member, whereby said upper end is free to move upwardly through the latch means and the latch means is returned by the urging means toward its lower position about said member beneath its upper end, and means for raising the latch means from its lower to its upper position in response to the supply of pressure fluid thereto from a source external to the housing.

6. An assembly of the character defined in claim 5, wherein said raising means comprises a sleeve slidably mounted within the bore of the housing beneath the recess to form a pressure chamber therebetween having a downwardly facing pressure responsive surface, and means for selectively supplying said fluid to the chamber to lift the sleeve and thus the latch means from its lower position.

7. An assembly for latching over and sealing about a tubular member having an enlarged diameter upper end, comprising a housing having a bore therein to receive the upper end of the member as it is lowered thereover and a recess thereabout having a downwardly and inwardly extending conical surface, latch means mounted in the recess for sliding along the conical surface between an upper expanded position to pass the upper end of the member and a lower contracted position to fit closely about the member beneath said upper end, said latch means being normally disposed in its lower position in which it may be engaged and raised into its upper position by the upper end of the member, as the housing is lowered over the member, whereby said upper end is free to move upwardly through the latch means and then permit the latch means to return to its lower position beneath said upper end, and means mounted within the recess of the housing above the latch means for sealing between the recess and the member beneath its upper end when it has moved upwardly through the latch means, means for raising the latch means from its lower to its upper position so that the latch means may be raised with the housing from the upper end of the member, and wherein said raising means comprises a sleeve slidably mounted within the bore of the housing beneath the recess, and means to lift the sleeve and thus the latch means from its lower position.

8. An assembly for latching over and sealing about a tubular member having an enlarged diameter upper end, comprising a housing having a bore therein to receive the upper end of the member as it is lowered thereover and a recess about the bore having a downwardly and inwardly extending conical surface, latch means mounted in the recess for sliding along the conical surface between an upper expanded position to pass the upper end of the member and a lower contracted position to fit about the member beneath said upper end, said latch means being normally disposed in its lower position in which it may be engaged and raised into its upper position by the upper end of the member, as the housing is lowered over the member, whereby said upper end is free to move upwardly through the latch means and then permit the latch means to return to its lower position beneath said upper end, means mounted within the recess of the housing above the latch means for sealing between the recess and the member beneath its upper end when it has moved upwardly through the latch means, means including inwardly convergent, upper and lower conically shaped retainer surfaces adjacent the upper and lower ends of the latch means, respectively, when the latch means is in its lower contracted position, so as to form a vertical space therebetween less than the vertical height of the latch means, and means for moving said surfaces relatively toward one another in order to move the latch means from its lower contracted to its upper expanded position.

9. An assembly of the character defined in claim 8, wherein the upper and lower ends of the latch means are conically shaped for sliding over the adjacent retainer surfaces as the latch means is raised to its upper expanded surface.

10. An assembly of the character defined in claim 8, including a sleeve vertically slidably in the bore and having the lower conically shaped retainer surface formed on its upper end, and means for raising the sleeve to move the latch means to its upper expanded position.

11. An assembly of the character defined in claim 10, including a ring mounted in the recess to support the sealing means therein and having the lower conically shaped retainer surface formed on its lower end.

12. An assembly for latching over and sealing about a tubular member having an enlarged diameter upper end, comprising a housing having a bore therein to receive the upper end of the member as it is lowered thereover and a recess about the bore having a downwardly and inwardly extending conical surface, latch means mounted in the recess for sliding along the conical surface between an upper expanded position to pass the upper end of the member and a lower contracted position to fit closely about the member beneath said upper end, said latch means being normally disposed in its lower position in which it may be engaged and raised into its upper position by the upper end of the member, as the housing is lowered over the member, whereby said upper end is free to move upwardly through the latch means and then permit the latch means to return to its lower position beneath said upper end, and means mounted within the recess of the housing above the latch means for sealing between the recess and the member beneath its upper end when it has moved upwardly through the latch means, said housing including an upper section having an upwardly opening upper recess portion whose lower end is of a size to permit the sealing means to be installed therein, a lower section having a downwardly opening lower recess portion on which the conical surface is formed and whose upper end is of a size to permit the latch means to be installed therein when the latch means is in its contracted position, and means threadedly connecting the upper and lower housing sections to one another intermediate the lower end of the sealing means and exterior of the housing, a ring held between the upper and lower housing sections in the recess to support the sealing means, and having a downwardly and inwardly extending conical surface adjacent the upper end of the latch means, and a sleeve vertically slidable in the bore section and having an upwardly and inwardly conical surface adjacent the lower end of the latch means when the latch means is in its lower contracted position, and means for raising the sleeve to its upper expanded position.

13. An assembly for latching over and sealing about a tubular member having an enlarged diameter upper end, comprising a housing having a bore therein to receive the upper end of the member as it is lowered thereover and a recess about the bore having a downwardly and inwardly extending conical surface, latch means mounted in the recess for sliding along the conical surface between an upper expanded position to pass the upper end of the member and a lower contracted position to fit closely about the member beneath said upper end, said latch means being normally disposed in its lower position in which it may be engaged and raised into its upper position by the upper end of the member, as the housing is lowered over the member, whereby said upper end is free to move upwardly through the latch means and then permit the latch means to return to its lower position beneath said upper end, means mounted within the bore of the housing above the latch means for sealing between the recess and the member beneath its upper end when it has moved upwardly through the latch means, means for raising the latch means from its lower contracted its upper expanded position so that the latch means may be raised with the housing from the upper end of the member, and means for determining when the latch means is in its lower position including a rod insertable through an opening in the housing to dispose its inner end in the recess only when the latch means is in such lower contracted position.

14. An assembly of the character defined in claim 13, wherein said position determining means also includes a bushing mounted on the outside of the housing and having the opening to closely receive the rod, said rod and bushing having lateral holes which are aligned only when the inner end of the rod is inserted into the recess, and a pin extending closely through the holes only when the rod is so inserted.

15. An assembly of the character defined in claim 13, wherein the rod is so located that, when inserted in the recess, its upper end prevents the latch means from being raised to its upper expanded position.

16. An assembly for latching over and sealing about a tubular member having an enlarged diameter upper end, comprising a housing having a bore therein to receive the upper end of the member as it is lowered thereover and a recess about the bore having a downwardly and inwardly extending conical surface, latch means mounted in the recess for sliding along the conical surface between an upper expanded position to pass the upper end of the member and a lower contracted position to fit closely about the member beneath said upper end, said latch means being normally disposed in its lower contracted position in which it may be engaged and raised into its upper expanded position by the upper end of the member, as the housing is lowered over the member, whereby said upper end is free to move upwardly through the latch means and then permit the latch means to return to its lower contracted position beneath said upper end, means mounted within the recess of the housing above the latch means for sealing between the recess and the member beneath its upper end when it has moved upwardly through the latch means, a sleeve vertically slidable in the housing bore beneath the latch means, means for raising and lowering the sleeve including an arm accessible from outside of the housing, and means connecting the arm to the sleeve in order to raise and lower the sleeve so as to raise and lower the latch means in response to actuation of the arm.

17. An assembly of the character defined in claim 16, wherein the arm is rotatably mounted on the housing, and the connecting means causes the sleeve to be raised as the arm is swung in one direction and lowered as it is swung in the opposite direction.

18. An assembly of the character defined in claim 17, wherein the sleeve engages an inner side of the latch means as it is raised to raise the latch means, so that the friction due to the tendency of the latch means to return to its lower position resists rotation of the arm in the opposite direction.

19. An assembly of the character defined in claim 18, wherein the arm is arranged to swing from an essentially vertical to an essentially horizontal position as it raises the sleeve.

20. An assembly of the character defined in claim 16, wherein a bushing is threadedly connected to the housing in a position to prevent rotation of the arm to its position to raise the sleeve, and a rod extending through the bushing and into the housing recess only when the latch means is lowered.

21. An assembly of the character defined in claim 20, wherein the rod, when so inserted in the recess, prevents the latch means from being raised to its upper position.

22. An assembly of the character defined in claim 21, wherein said rod and bushing have lateral holes which are aligned only when the inner end of the rod is inserted into the recess, and including a pin extending closely through the holes only when the rod is so inserted.

* * * * *